US008100788B2

(12) United States Patent
Sanford

(10) Patent No.: US 8,100,788 B2
(45) Date of Patent: Jan. 24, 2012

(54) ARROWHEAD

(76) Inventor: Chris G. Sanford, Billings, MT (US)

( * ) Notice: Subject to any disclaimer, the term of this patent is extended or adjusted under 35 U.S.C. 154(b) by 603 days.

(21) Appl. No.: 12/002,251

(22) Filed: Dec. 14, 2007

(65) Prior Publication Data

US 2009/0156336 A1 Jun. 18, 2009

(51) Int. Cl.
*F42B 6/08* (2006.01)

(52) U.S. Cl. ..... 473/584; 473/582; 473/583

(58) Field of Classification Search ..... 473/582–584; 30/337, 353

See application file for complete search history.

(56) References Cited

U.S. PATENT DOCUMENTS

| | | | | | |
|---|---|---|---|---|---|
| 2,137,014 | A | | 11/1938 | Brochu | |
| 2,265,564 | A | * | 12/1941 | Klopsteg | 473/582 |
| 2,816,766 | A | * | 12/1957 | Stockfleth | 473/584 |
| 2,829,894 | A | * | 4/1958 | Henkel | 473/584 |
| 2,880,000 | A | * | 3/1959 | Unger | 473/584 |
| 2,909,372 | A | * | 10/1959 | Neri | 473/584 |
| 3,021,138 | A | * | 2/1962 | Smith | 473/584 |
| 3,741,542 | A | * | 6/1973 | Karbo | 473/584 |
| 3,854,723 | A | * | 12/1974 | Wilson | 473/585 |
| 3,887,186 | A | | 6/1975 | Matlock, Jr. | |
| 4,029,319 | A | * | 6/1977 | Christen | 473/584 |
| 4,349,202 | A | * | 9/1982 | Scott | 473/584 |
| 4,570,941 | A | * | 2/1986 | Saunders | 473/584 |
| 4,616,835 | A | | 10/1986 | Trotter | |
| 4,928,969 | A | * | 5/1990 | Nagatori | 473/584 |
| 4,940,246 | A | | 7/1990 | Stagg | |
| 5,090,709 | A | | 2/1992 | Johnson | |
| 5,165,697 | A | | 11/1992 | Lauriski et al. | |
| 5,931,751 | A | * | 8/1999 | Cooper | 473/583 |
| 6,015,357 | A | * | 1/2000 | Rizza | 473/583 |
| 6,322,464 | B1 | | 11/2001 | Sestak | |
| 6,530,853 | B1 | * | 3/2003 | Giannetti | 473/584 |
| 6,554,727 | B1 | * | 4/2003 | Armstrong et al. | 473/584 |
| 6,830,523 | B1 | | 12/2004 | Kuhn | |
| 7,037,223 | B2 | | 5/2006 | Kuhn | |
| 7,871,345 | B2 | * | 1/2011 | Cooper | 473/584 |
| 2004/0092342 | A1 | | 5/2004 | Perkins, Sr. | |
| 2005/0159255 | A1 | | 7/2005 | Barrie | |
| 2006/0084535 | A1 | * | 4/2006 | Kuhn | 473/583 |
| 2006/0194658 | A1 | | 8/2006 | Kuhn | |
| 2006/0276276 | A1 | | 12/2006 | Polando | |
| 2007/0078034 | A1 | | 4/2007 | Maleski | |
| 2007/0111831 | A1 | | 5/2007 | Sohm | |
| 2008/0261734 | A1 | * | 10/2008 | Cooper | 473/584 |
| 2009/0233742 | A1 | * | 9/2009 | Sanford | 473/584 |

* cited by examiner

*Primary Examiner* — Alvin Hunter
*Assistant Examiner* — Scott Young
(74) *Attorney, Agent, or Firm* — Foley & Lardner LLP

(57) ABSTRACT

An arrowhead includes a body having a longitudinal axis, a first blade, and a first fastener that extends through a portion of the body and engages the first blade to secure the first blade in position relative to the body. The first fastener is offset relative to the longitudinal axis.

22 Claims, 16 Drawing Sheets

ARROWHEAD

BACKGROUND

The present invention relates generally to the field of arrowheads for arrows, and more specifically, to an improved fixed-blade broadhead for arrows.

Many types of arrowheads used for arrows include one or more fixed blades. However, there are many challenges in providing a reliable and effective arrowhead that is also simple to produce and easy to use.

It would therefore be desirable to provide an improved arrowhead that overcomes the disadvantages of conventional arrowheads.

DETAILED DESCRIPTION

Figure 1:
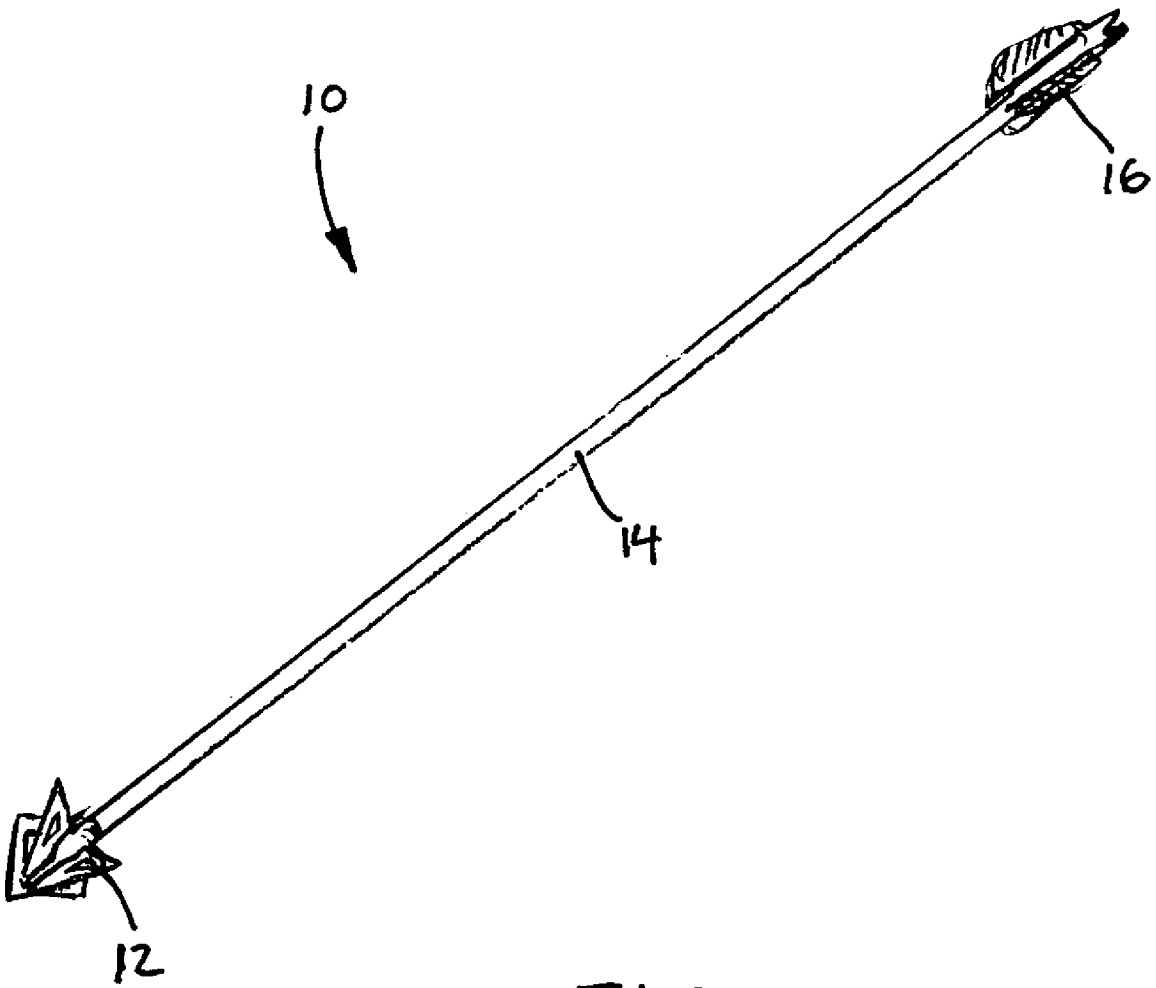
FIG. 1 is a perspective view of an arrow having an arrowhead according to an exemplary embodiment.

Referring to FIG. 1, an arrow 10 according to an exemplary embodiment is shown. Arrow 10 includes an arrowhead 12 and a shaft 14. Shaft 14 may be an elongated member that may be formed from a wide variety of materials such as metal, plastic, fiber-reinforced composites, hardwood, softwood, etc., or a combination of suitable materials. According to an exemplary embodiment, a fletching 16 is coupled to one end of shaft 14 and arrowhead 12 is coupled to shaft 14 at a second end opposite of fletching 16. Other arrowhead configurations may be used in conjunction with arrowhead 12 according to various other exemplary embodiments.

Figure 2:
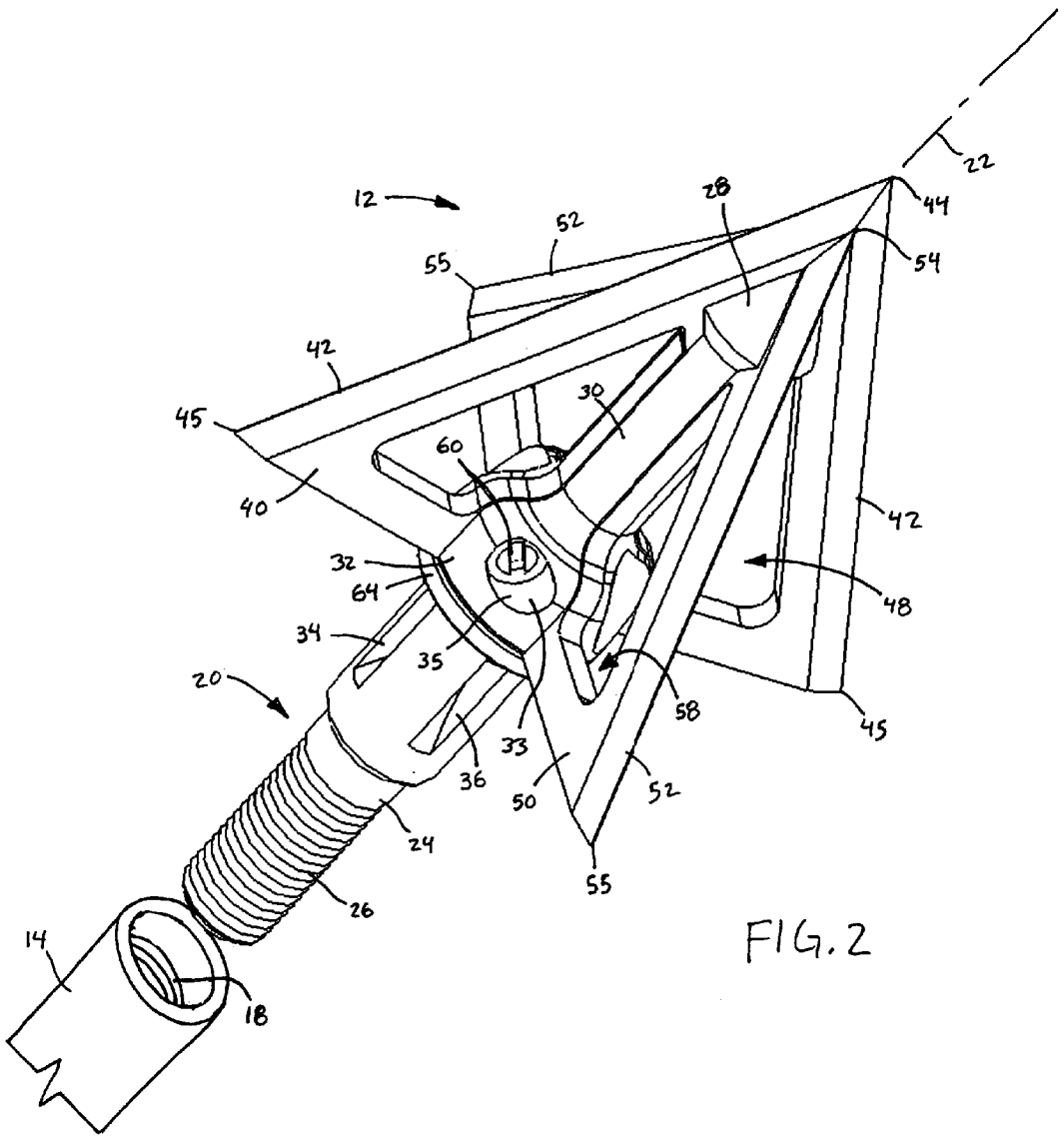
FIG. 2 is a side perspective view of an arrowhead according to an exemplary embodiment.
Figure 3:
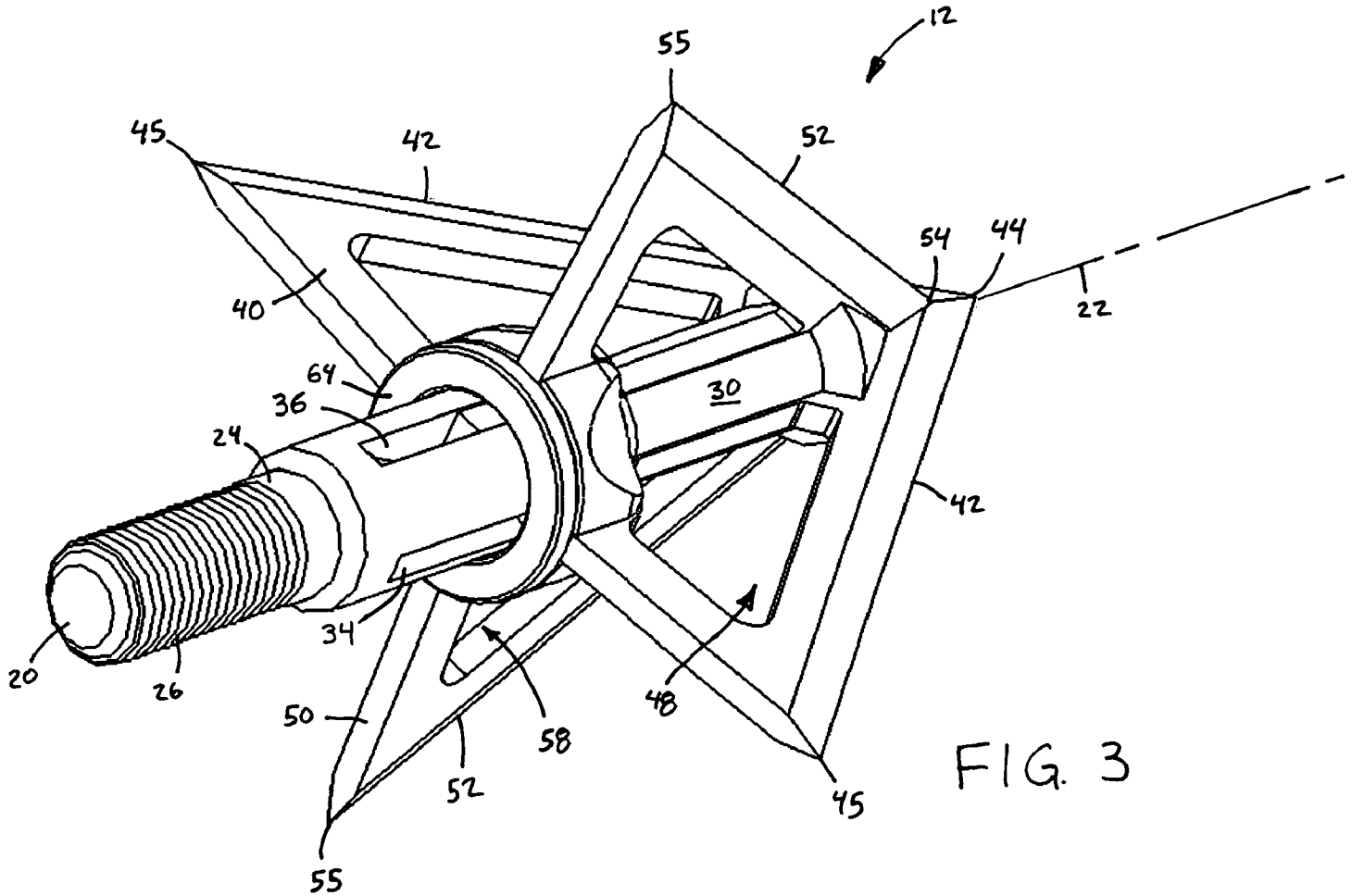
FIG. 3 is a reverse side perspective view of the arrowhead of FIG. 2 according to an exemplary embodiment.
Figure 4:
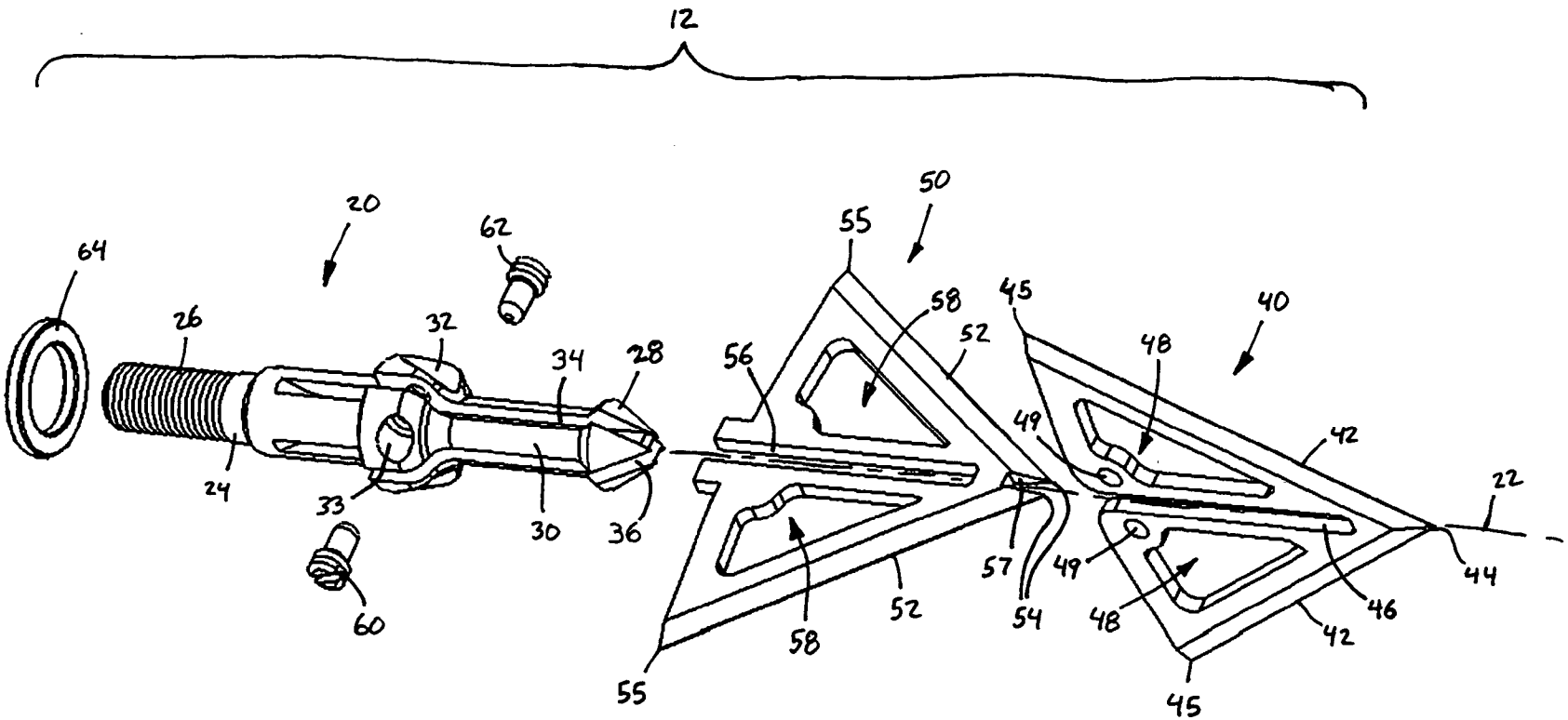
FIG. 4 is an exploded perspective view of the arrowhead of FIG. 2 according to an exemplary embodiment.

Referring to FIGS. 2-4, arrowhead 12 is shown in greater detail according to an exemplary embodiment. According to an exemplary embodiment, arrowhead 12 is a fixed-blade broadhead that utilizes fixed blades rather than blades that include moving components (e.g., "mechanical" blades). Arrowhead 12 includes a main body or ferrule 20 that receives a first blade 40 and a second blade 50, and fasteners 60 and 62 that secure one or more of blades 40, 50 to body 20. Blades 40, 50 may be configured to be removable (e.g., replaceable) and may be arranged such that they extend beyond the forward-most portion of body 20 to form a cut-on-contact tip for arrowhead 12 (e.g., such that during use, the blade tips 44, 54 of blades 40, 50 strike the intended target prior to body 20).

According to an exemplary embodiment, body 20 is an elongated member that has a longitudinal axis 22 that is generally coaxial with shaft 14. Body 20 includes a rear portion 24 and a forward portion 28 with recesses 34, 36 that receive first blade 40 and second blade 50, respectively. Rear portion 24 may include threads 26 and be configured to engage a threaded socket 18 in shaft 14 to couple arrowhead 12 to shaft 14. According to an exemplary embodiment, threaded socket 18 may include a separate threaded insert that may be glued or otherwise coupled to shaft 14. Forward portion 28 includes a first or elongated portion 30 and a second or enlarged portion 32 proximate rear portion 24.

Figure 15:
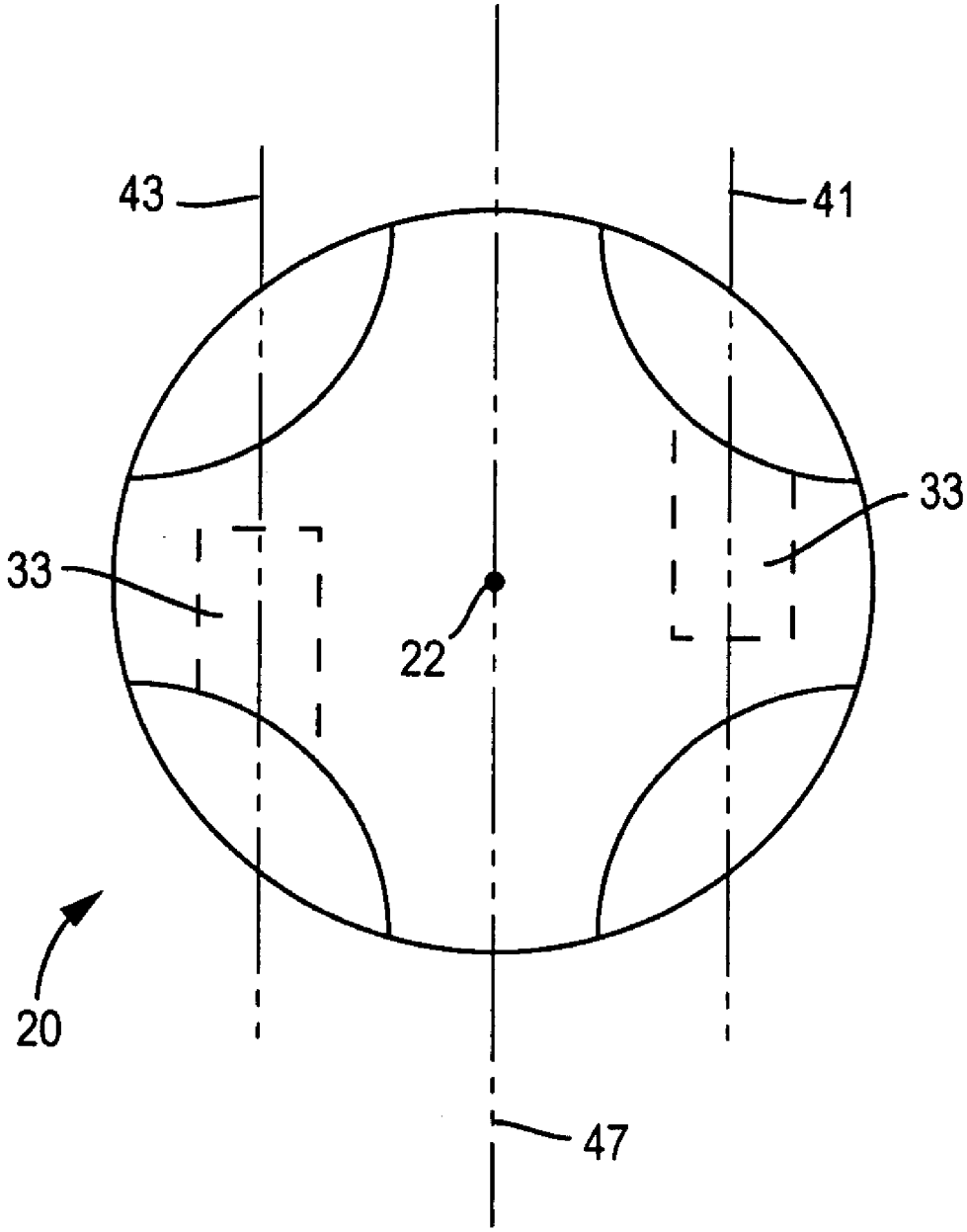
FIG. 15 is a cross-section view of a portion of an arrowhead taken along line 15-15 of FIG. 10 according to an exemplary embodiment

According to an exemplary embodiment, second portion 32 may be a generally cylindrical body that is generally symmetrical about longitudinal axis 22. Second portion 32 includes one or more apertures 33 that are offset from longitudinal axis 22. Apertures 33 may comprise a recessed portion 35 when fasteners 60, 62 are in a tightened position. Fasteners 60, 62 are received in apertures 33 and are therefore offset from longitudinal axis 22 in a similar manner. For example, according to one embodiment, apertures 33 (and fasteners 60, 62) may be configured such that apertures 33 do not intersect longitudinal axis 22 (or do not extend in a direction that intersects axis 22). According to an alternative embodiment, apertures 33 may extend orthogonally with respect to longitudinal axis 22 and be spaced apart from longitudinal axis 22 at equal or unequal distances to either side of longitudinal axis 22. According to yet another embodiment, shown in FIG. 15, one or more of apertures 33 may extend in a plane 41 or 43 that is parallel to and/or spaced apart from a plane 47 that encompasses longitudinal axis 22.

According to an exemplary embodiment, apertures 33 are aligned with corresponding apertures 49 (see FIG. 4) in first blade 40 and receive fasteners 60 and 62 to couple first blade 40 to body 20. When arrowhead 12 is assembled, apertures 49 are aligned with apertures 33 in body 20. According to an exemplary embodiment, body 20 may be formed from steel. According to other exemplary embodiments, body 20 may be formed from other materials, such as aluminum, etc. Providing a steel body may provide a stronger body portion over alternative metals such as aluminum. According to an exemplary embodiment, enlarged portion 32 may have a radius and circumference greater than the radius and circumference of elongated portion 30. For example, the radius of enlarged portion 32 may be at least about 1.2 times the radius of elongated portion 30, or at least about 1.5 or 2.0 times the radius of elongated portion 30 in alternative embodiments.

First blade 40 may be a generally triangular, replaceable blade and may be removable from body 20. First blade 40 includes a pair of cutting edges 42. Each of cutting edges 42 may extend from a tip 44 to an apex 45 to form a side of first blade 40. A slot or groove 46 may be formed along the centerline of blade 40. Slot 46 extends from the portion of blade 40 opposite tip 44 to a portion proximate tip 44. In this embodiment, slot 46 may extend along at least one-half, at least two-thirds, or at least three-quarters of the length of blade 40. Two apertures 48 may be provided on either side of slot 46 between slot 46 and cutting edges 42. Apertures 48 may be configured to permit air to flow through the apertures and pass through blade 40. In this embodiment, apertures 48 may have an area that is at least one-quarter, at least one-third, or at least one-half of the surface area of one side of blade 40. While apertures 48 are shown as generally triangular openings in FIGS. 1-4, according to other exemplary embodiments, apertures 48 may be otherwise shaped or may include a multitude of openings in blade 40. According to an exemplary embodiment, apertures 48 may be symmetric about axis 22 and have identical or substantially similar shapes and sizes.

Second blade 50 may be a generally triangular, replaceable blade and may be removable from body 20. Second blade 50 includes a pair of cutting edges 52. Each of cutting edges 52 may extend from one of two tips 54 to an apex 55 to form a side of blade 50. According to an exemplary embodiment, cutting edges 52 of second blade 50 have a length that is approximately the same as the length of cutting edges 42 of first blade 40. According to other embodiments, cutting edges 42 and 52 may be of substantially different lengths. A slot or groove 56 is formed along the centerline of blade 50. Slot 56 extends from the portion of blade 50 opposite of tips 54 toward tips 54. In this embodiment, slot 56 may extend along at least one-half, at least two-thirds, or at least three-quarters of the length of blade 50. A slot or groove 57 may also formed along the centerline of blade 50. Slot 57 extends between tips 54 toward slot 56. Two apertures 58 may be provided on either side of slot 56 between slot 56 and cutting edges 52. Apertures 58 may be configured to permit air to flow through apertures 58 and pass through blade 50. In this embodiment, apertures 58 may have an area that is at least one-quarter, at least one-third, or at least one-half of the surface area of one side of blade 50. According to an exemplary embodiment, apertures 58 are approximately the same size as apertures 48 in first blade 40. According to another exemplary embodiment, apertures 58 may be symmetric about axis 22 and have identical or substantially similar shapes and sizes. Providing similarly sized apertures 48 and 58 in first blade 40 and second blade 50 may help to improve the stability of arrow 10 during flight by providing balanced airflow through arrowhead 12. While apertures 58 are shown as generally triangular openings in FIGS. 1-4, according to other exemplary embodiments, apertures 58 may be otherwise shaped or may include a multitude of openings in blade 50.

According to an exemplary embodiment, first blade 40 and second blade 50 may be formed from steel. According to other exemplary embodiments, first blade 40 and second blade 50 may be formed from other suitable materials.

As shown in FIG. 4, body 20 may include recesses or grooves 34, 36 that receive first blade 40 and second blade 50, respectively. Recesses 34, 36 extend along portions of the length of body 20 and are generally perpendicular such that first blade 40 and second blade 50 are oriented at right angles to each other when they are coupled to body 20, although the recesses may be substantially non-perpendicular (e.g., about 30 degrees apart, about 45 degrees apart, etc.) according to various other embodiments.

According to an exemplary embodiment, to assemble arrowhead 12, second blade 50 is first inserted into body 20 such that recess 36 engages slot 56 on second blade 50. First blade 40 is then slid into body 20 perpendicular to second blade 50 such that recess 34 engages slot 46 on first blade 40. When fully seated in body 20, slot 46 on first blade 40 is also received by slot 57 on blade 50, and apertures 49 are aligned with apertures 33 in body 20. First fastener 60 and/or second fastener 62 are provided on either side of longitudinal axis 22 and are inserted through apertures 49 to couple first blade 40 to body 20. First blade 40 secures (e.g., overlaps, locks, tightens, etc.) second blade 50 in place between blade 40 and body 20. According to an exemplary embodiment, fasteners 60 and 62 are set screws. Fasteners 60 and 62 are offset relative to longitudinal axis 22 and pass through a portion of body 20 to engage threaded apertures in body 20. While fasteners 60 and 62 are shown in the FIGURES as set screws, according to other exemplary embodiments, fasteners 60 and 62 may be rivets, pins, dowels, press-fit fasteners, or any other suitable fastening device.

According to an exemplary embodiment, threads 26 on rear portion 24 of body 20 engage threaded socket 18 to couple arrowhead 12 to shaft 14. A ring member 64 (e.g., washer, etc.) may be provided between the end of shaft 14 and second portion 32 of body 20. Ring member 64 may engage a portion of blade 50 (e.g., a bottom or rear edge portion) to secure blade 50 between ring member 64 and blade 40. As the shaft 14 is tightened to arrowhead 12, ring member 64 may further tighten blade 50 by tending to push blade 50 toward blade 40, which is fastened in place by fasteners 60, 62. According to other exemplary embodiments, ring member 64 may be eliminated and the end of shaft 14 may contact second portion 32 and/or blades 40 and 50. If ring member 64 is not used, recess 36 may be sized (e.g., shortened relative to the FIGURES) such that blade 50 is tightly secured between blade 40 and body 20 when blade 40 is fastened in place.

The unique method of coupling first blade 40 and second blade 50 to body 20 allows blades 40 and 50 to be removable and to be arranged such that they extend beyond the forward-most portion of body 20 to form a cut-on-contact tip for arrowhead 12 in some exemplary embodiments. By using offset fasteners, blades of similar sizes, shapes, and weights may be used because there are no fasteners extending through the central portion (e.g., along a central or longitudinal axis) of the body or ferrule in some exemplary embodiments. Furthermore, because blades dull every time the blades contact a target, providing removable blades 40, 50 allow blades 40, 50 to be regularly removed and sharpened and/or replaced, in some exemplary embodiments.

Further, blades 40, 50 are similarly sized and form apertures 48 and 58 that are similarly sized in some exemplary embodiments. This symmetry of the shape and weight distribution of blades 40, 50 about longitudinal axis 22 may facilitate a more stable flight for arrow 10. A more stable flight may provide for better shot placement and penetration of arrow 10. For example, according to an exemplary embodiment as shown in FIG. 2, the distance between body 20 and cutting edge 42, and the distance between body 20 and cutting edge 52, may be substantially the same along the length of body 20.

Arrowhead 12 may provide further advantageous features when arrow 10 impacts a target. Using first blade 40 to secure second blade 50 to body 20 and using two opposing fasteners 60 and 62 to fasten first blade 40 to body 20 may help prevent blades 40 and 50 from falling or tearing off of body 20.

Figure 5:
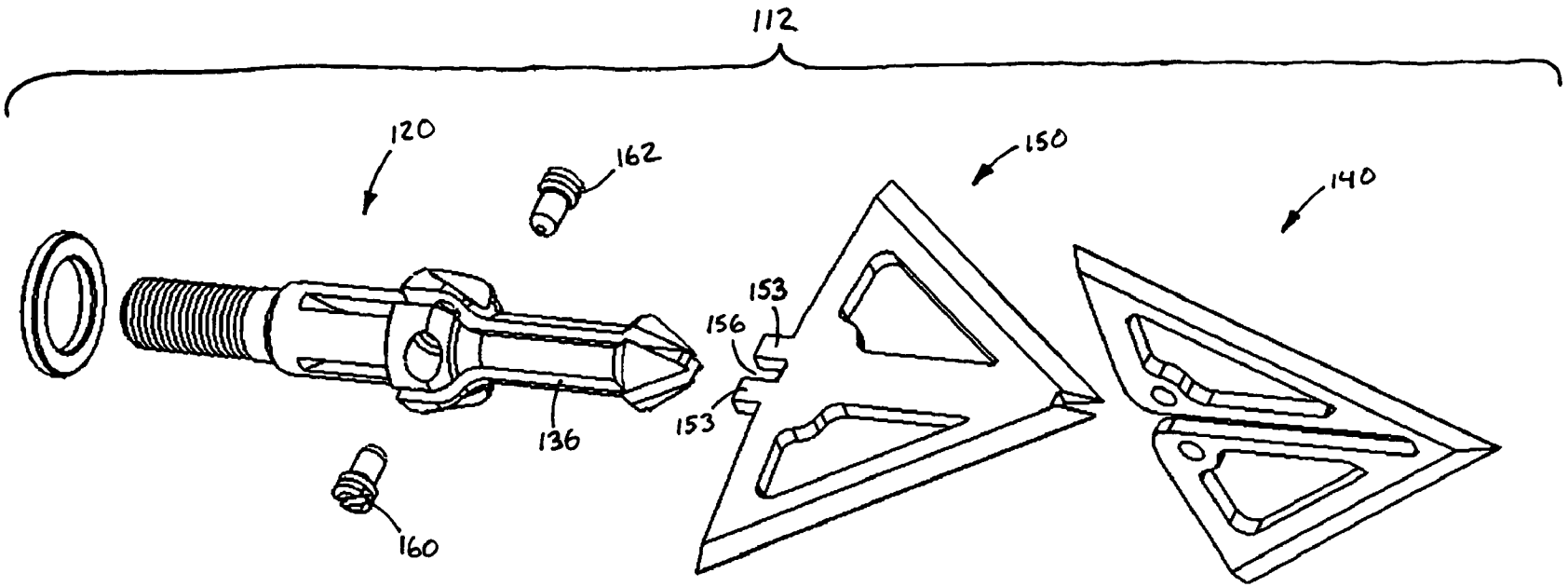
FIG. 5 is an exploded perspective view of the arrowhead of FIG. 2 according to another exemplary embodiment.
Figure 6:
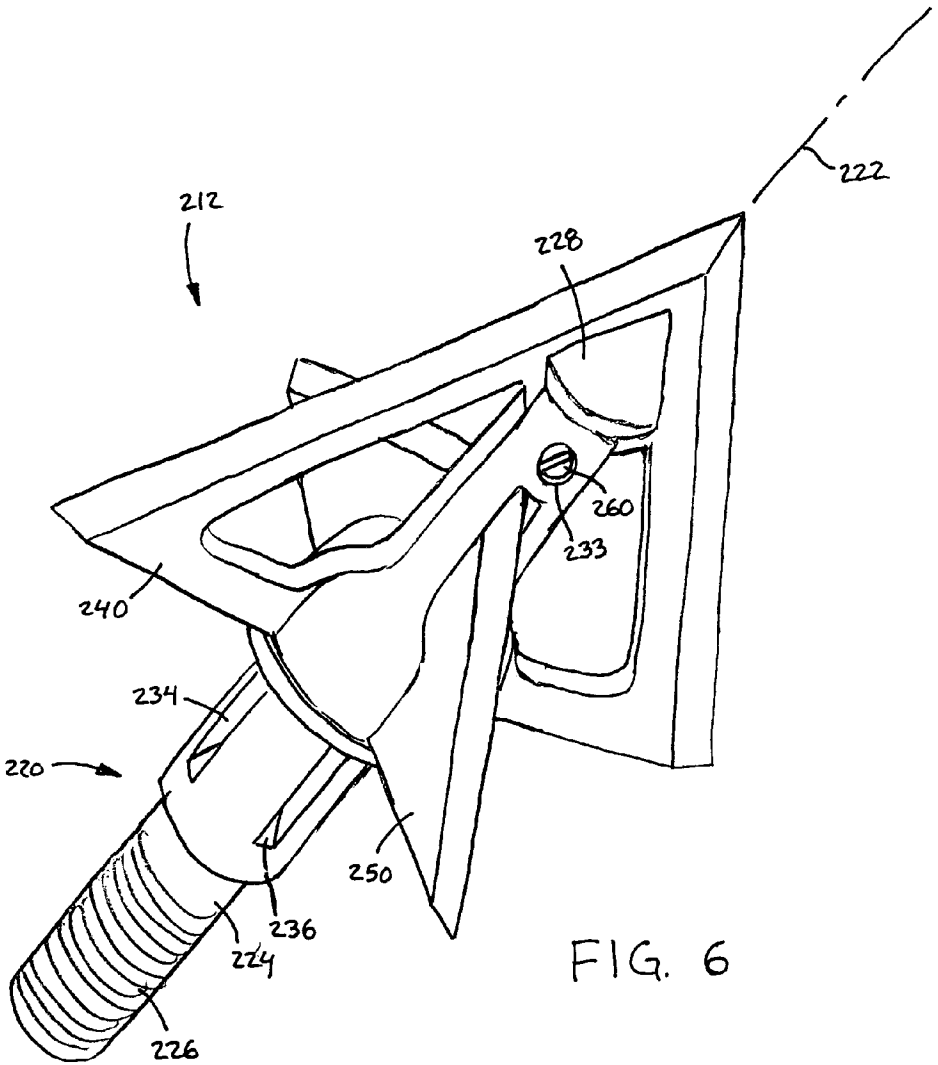
FIG. 6 is a perspective view of an arrowhead according to another exemplary embodiment.
Figure 10:
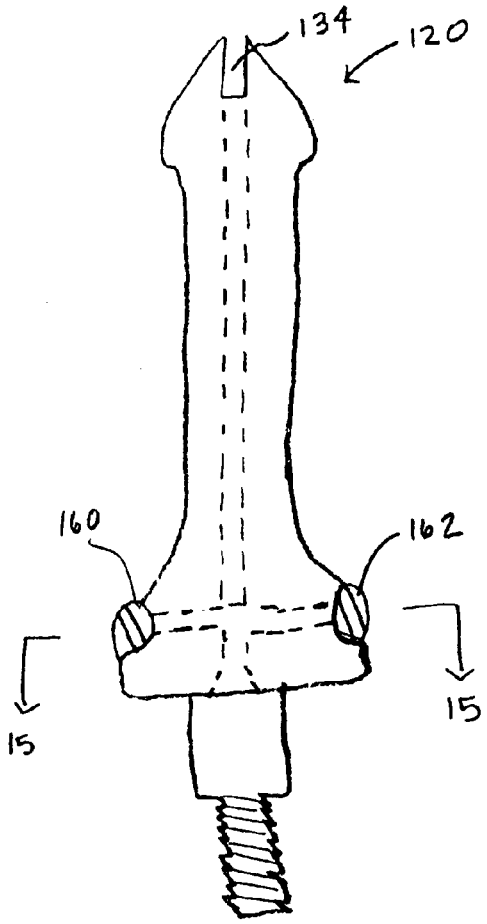
FIG. 10 is a front view of a portion of an arrowhead according to an exemplary embodiment.
Figure 11:
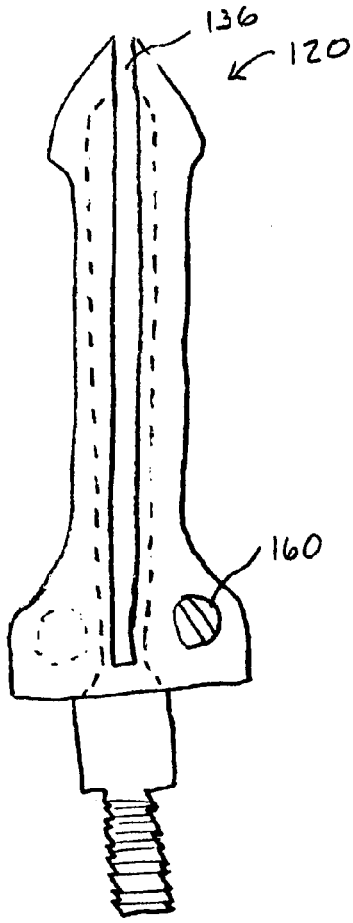
FIG. 11 is a side view of the portion of the arrowhead of FIG. 10 according to an exemplary embodiment.

Referring now to FIGS. 5 and 10-11, an arrowhead 112 is shown according to an exemplary embodiment. Arrowhead 112 is similar to arrowhead 12 of FIG. 4 and includes a main body or ferrule 120, a first blade 140, a second blade 150 secured between first blade 140 and body 120, and fasteners 160 and 162 that secure one or more of blades 140, 150 to body 120. Blades 140, 150 are configured to be removable (e.g., replaceable) and are arranged such that they extend beyond body 120 to form a cut-on-contact tip for arrowhead 112.

Second blade 150 is a generally triangular, replaceable blade and is removable from body 120. Second blade is similar to blade 50, but a slot or groove 156 extends inward from the side of blade 150 opposite of tips 154 a length substantially less than the length of slot 56 of blade 50. For example, the length of slot 156 may be less than one-half of the total length of blade 150, or less than one-third, or less than one-fourth, the length of blade 150. Accordingly, body 120 includes a recess 136 (see FIG. 11) that extends through body 120 that is substantially longer than recess 36 provided on body 20 in order to accommodate the corresponding shorter slot 156 in second blade 150. In this embodiment, recess 136 extends along at least one-half, at least two-thirds, or at least three-fourths, of the length of body 120. Extensions 153 are provided on either side of slot 156. Extensions 153 are received in recess 136 and help to locate second blade 150 relative to body 120. According to other exemplary embodiments, blade 150 may be provided without extensions 153. First blade 140 may be similar to first blade 40 and fit over second blade 150 to secure second blade 150 to body 120. First blade 140 is received in a recess or groove 134 (see FIG. 10). One advantage that the configuration of FIG. 5 may provide is a more stable second blade because of the shorter slot and increased surface area of the blade, which may increase the stability of the arrowhead during flight.

Referring now to FIGS. 6-7A and 12-13, an arrowhead 212 is shown according to an exemplary embodiment. Arrowhead 212 includes a main body or ferrule 220, a first blade 240, a second blade 250 secured between first blade 240 and body 220, and a fastener 260 that secures one or more of blades 240, 250 to body 220. Blades 240 and 250 are configured to be removable (e.g., replaceable) and are arranged such that first blade 240 extends beyond body 220 to form a cut-on-contact tip for arrowhead 212. According to an exemplary embodiment, arrowhead 212 may have differently sized blades. According to an exemplary embodiment, first blade 240 is similar to first blades 40 and 140, but second blade 250 is substantially smaller than second blades 50 and 150. According to another exemplary embodiment, a blade such as blade 280 shown in FIG. 7C may be used in place of first blade 240, such that second blade 250 may be slid into slot 286 in blade 280 during assembly of the arrowhead.

According to an exemplary embodiment, body 220 may be an elongated member that has a longitudinal axis 222 that is coaxial with shaft 14 (see FIG. 2). Body 220 includes a rear portion 224 and a forward portion 228. Rear portion 224 may include threads 226 and be configured to engage threaded socket 18 to couple arrowhead 212 to shaft 14. Body 220 includes recesses 234, 236 (e.g., slots, grooves, etc.). Recess 234 may be similar to recess 34 on arrowhead 12 and be configured to receive first blade 240. Recess 236 is provided along the length of body 220. Recess 236 may be aligned with longitudinal axis 222 and be generally perpendicular to recess 234, although in some embodiments, the recesses may be provided at other angles relative to each other (e.g., 30 degrees, 45 degrees, etc.). Recess 236 is configured to receive second blade 250. Forward portion 228 may further include an aperture 233 that is aligned with a corresponding aperture in 249 first blade 240. Aperture 233 receives fastener 260 to couple first blade 240 to body 220.

A ring member 264 (e.g., washer, etc.) may be provided between the end of shaft 14 and second portion 232 of body 220. Ring member 264 may engage a portion of blade 250 (e.g., a bottom or rear edge portion) to secure blade 250 between ring member 264 and blade 240. According to other exemplary embodiments, ring member 264 may be eliminated and the end of shaft 14 may contact second portion 232 and/or blades 240 and 250. If ring member 264 is not used, recess 236 may be sized (e.g., shortened relative to the FIGURES) such that blade 250 is tightly secured between blade 240 and body 220 when blade 240 is fastened in place.

According to an exemplary embodiment, first blade 240 may be a generally triangular, replaceable blade and be removable from body 220. First blade 240 may be substantially similar to first blade 40, but include a single aperture 249. Aperture 249 may be provided in a middle portion of first blade 240 and may be aligned with longitudinal axis 222. When arrowhead 212 is assembled, aperture 249 is aligned with aperture 233 in body 220. Second blade 250 may be shaped similarly to second blade 150, but is substantially shorter in the direction of axis 222 than first blade 240 to accommodate fastener 260. Blade 250 may also have one or more apertures to permit airflow during flight.

Figure 12:
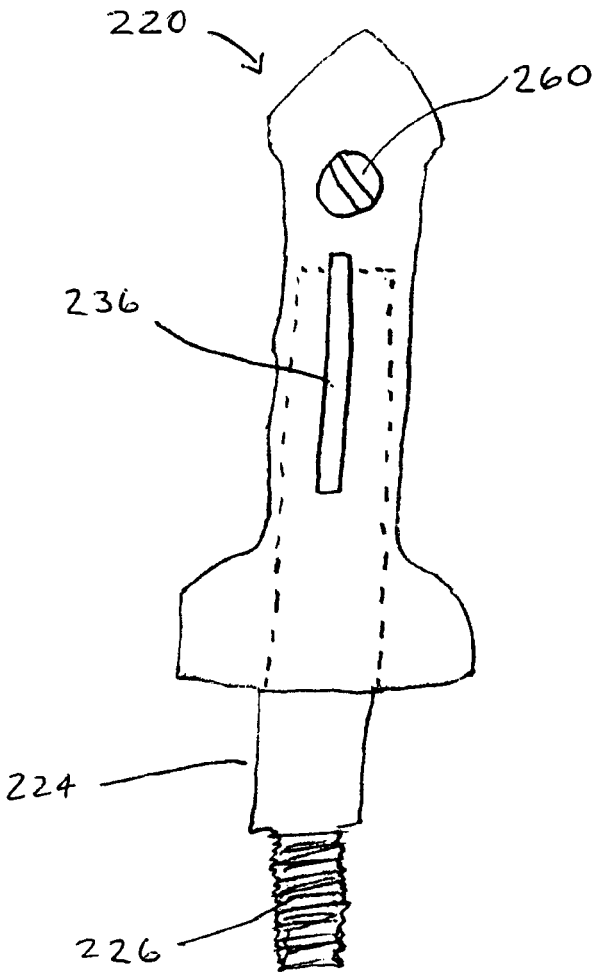
FIG. 12 is a front view of a portion of an arrowhead according to an exemplary embodiment.
Figure 13:
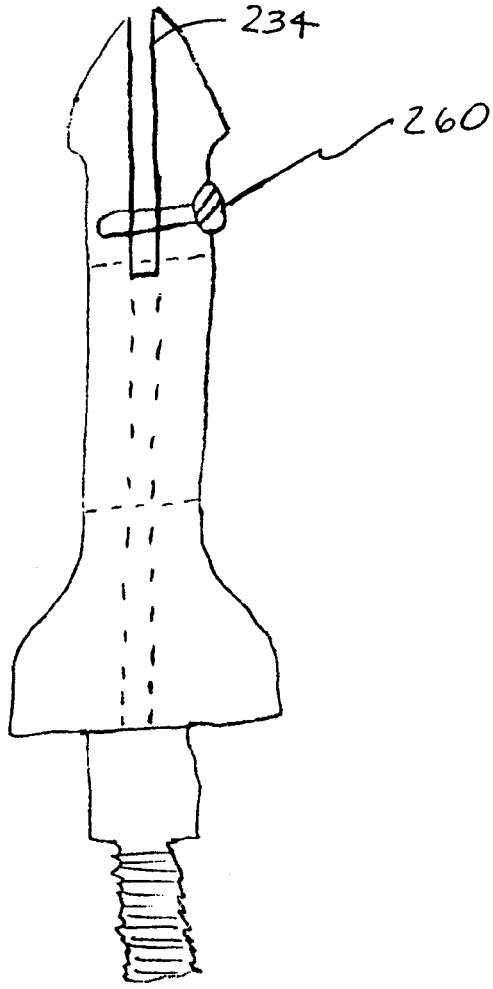
FIG. 13 is a side view of the portion of the arrowhead of FIG. 12 according to an exemplary embodiment.

To assemble arrowhead 212, second blade 250 is first inserted from the side into body 220 through recess 236 (see FIG. 12). First blade 240 is then slid into body 220 perpendicular to second blade 250 such that recess 234 on body 220 engages slot 246 on first blade 240. When fully seated in body 220, slot 246 on first blade 240 is received by second slot 257 on second blade 250 and aperture 249 is aligned with aperture 233 in body 220. First fastener 260 is inserted through aperture 249 to couple first blade 240 to body 220. First blade 240 further secures second blade 250 in place. According to an exemplary embodiment, fastener 260 is a set screw. Alternatively, fastener 260 may be a pin, rivet, dowel, or other suitable fastener. Fastener 260 may extend in a direction that intersects with longitudinal axis 222 and may extend into a portion of body 220 to engage a threaded aperture (e.g., aperture 233) in body 220. Alternatively, fastener 260 may be provided offset relative to axis 222 and more than one fastener may be used according to various alternative embodiments.

Figure 7A:
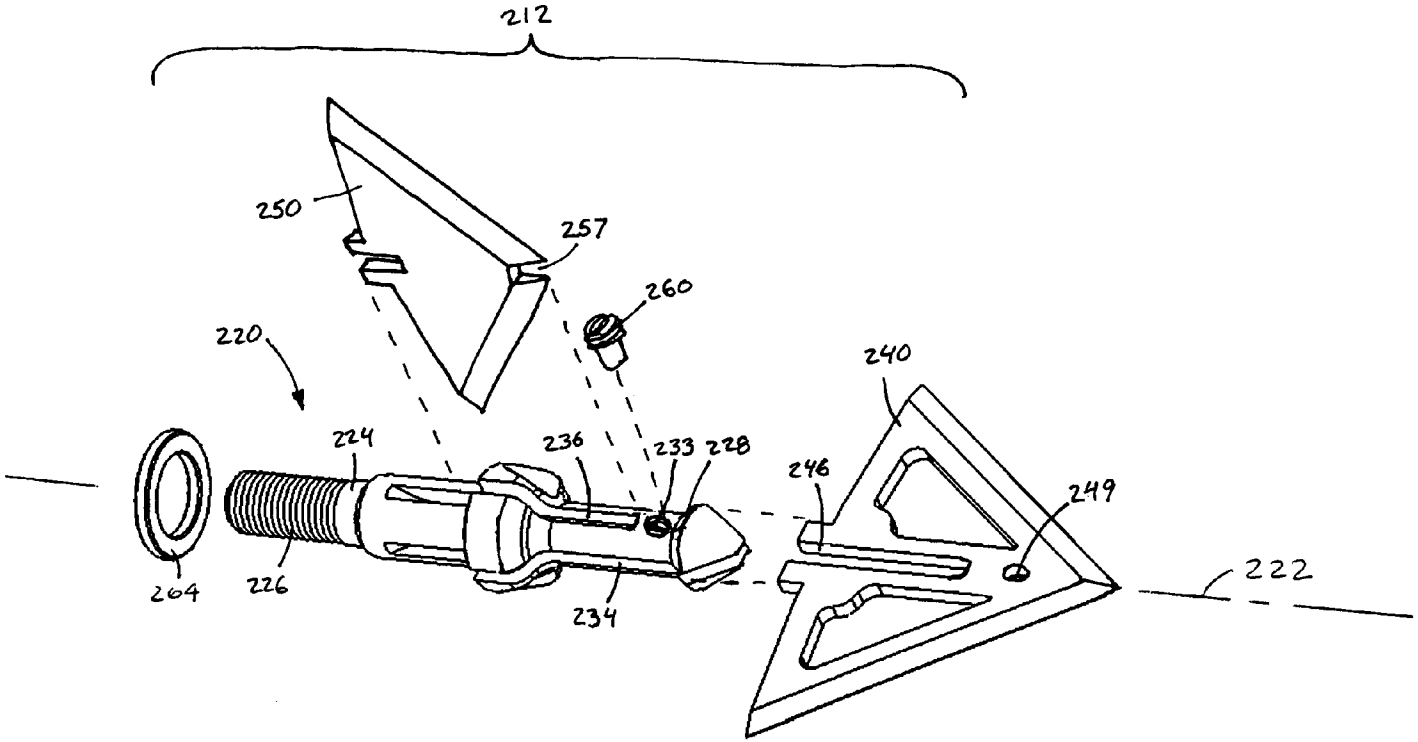
FIG. 7A is an exploded perspective view of the arrowhead of FIG. 6 according to an exemplary embodiment.
Figure 7C:
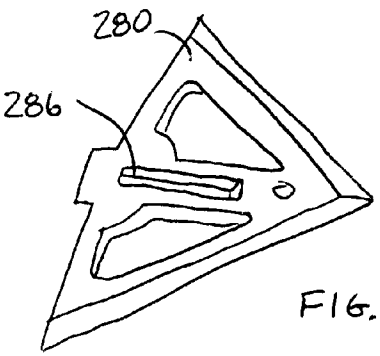
FIG. 7C is a perspective view of a blade for an arrowhead according to an exemplary embodiment.
Figure 7B:
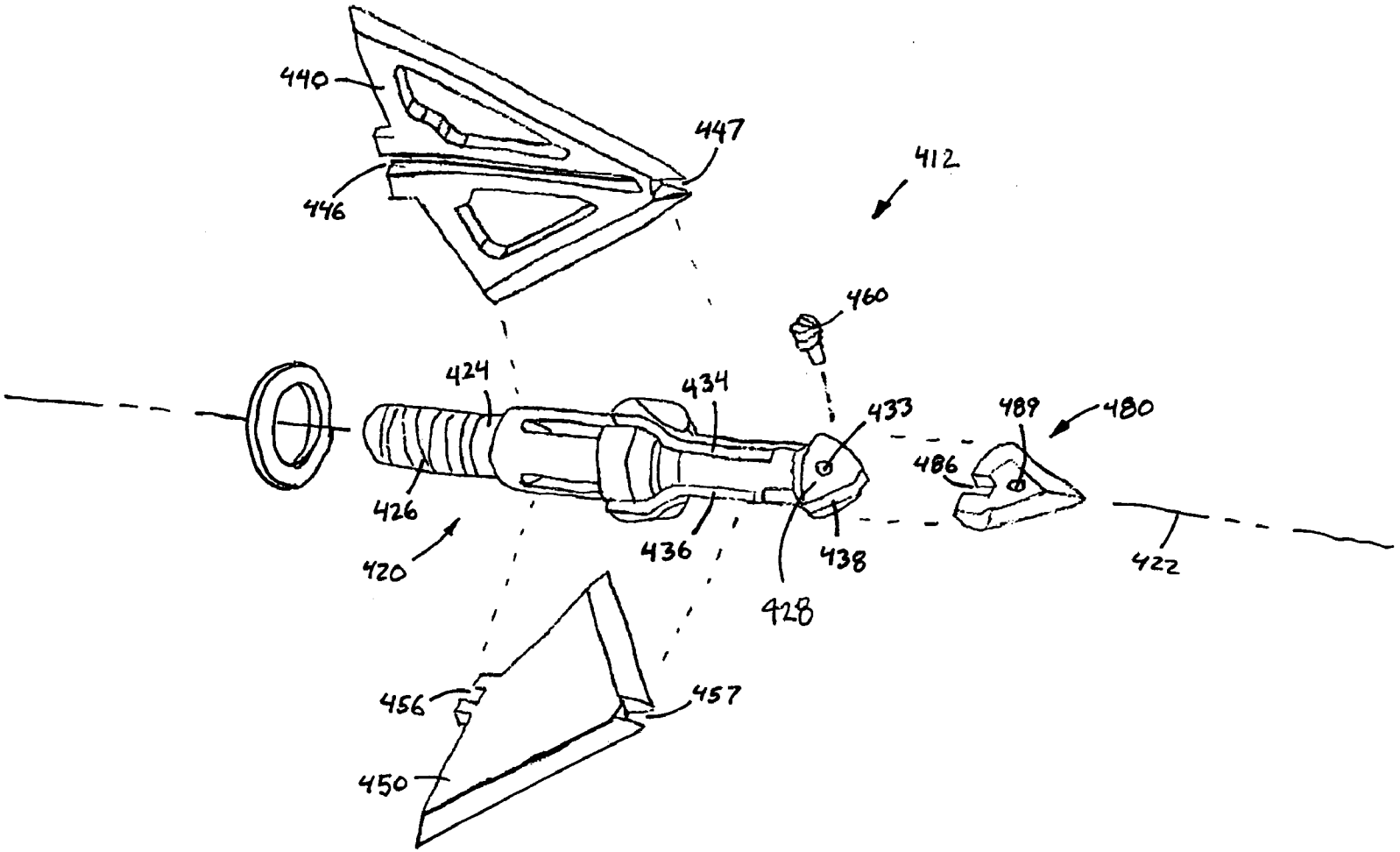
FIG. 7B is an exploded perspective view of an arrowhead according to an exemplary embodiment.

Referring now to FIG. 7B, an arrowhead 412 is shown according to an exemplary embodiment. Arrowhead 412 includes a main body or ferrule 420, a first blade 440, a second blade 450 secured between first blade 440 and body 420, a third blade 480 that traps first blade 440 against body 420, and a fastener 460 that secures one or more of blades 440, 450, and 480 to body 420. Blades 440, 450, and 480 are configured to be removable (e.g., replaceable) and are arranged such that third blade 480 extends beyond body 420 to form a cut-on-contact tip for arrowhead 412. According to an exemplary embodiment, arrowhead 412 may have differently sized blades. According to an exemplary embodiment, first blade 440 is similar to first blades 40 and 140, but second blade 450 is substantially smaller than second blades 50 and 150. Third blade 480 is substantially smaller than both first blade 440 and second blade 450.

According to an exemplary embodiment, body 420 may be an elongated member that has a longitudinal axis 422 that is coaxial with shaft 14 (see FIG. 2). Body 420 includes a rear portion 424 and a forward portion 428. Rear portion 424 may include threads 426 and be configured to engage threaded socket 18 to couple arrowhead 412 to shaft 14. Body 420 includes recesses 434, 436 (e.g., slots, grooves, etc.). Recesses 434 and 436 are provided along the length of body 420 and are configured to receive first blade 440 and second blade 450, respectively. A third recess or groove 438 is provided on the end of forward portion 428 that is configured to receive third blade 480. Forward portion 428 may further include an aperture 433 that is aligned with a corresponding aperture 489 in third blade 480. Aperture 433 receives fastener 460 to couple third blade 480 to body 420.

According to an exemplary embodiment, third blade 480 may be a generally triangular, replaceable blade and be removable from body 420. Third blade 480 includes aperture 489. Aperture 489 may be provided in a middle portion of third blade 480. When arrowhead 412 is assembled, aperture 489 may be aligned with aperture 433 in body 420.

To assemble arrowhead 412, first blade 440 is first inserted from the side into body 420 through recess 434. Second blade 450 is then slid into body 420 perpendicular to second blade 450 through recess 436 and slot 446 such that slot 457 on second blade 450 engages groove 446 on first blade 440. When fully seated in body 420, slot 446 on first blade 440 is received by second slot 457 oil second blade 450 and groove 456 engages body 420. Third blade 480 is then slid into recess 438 of body 420 such that slot 486 on third blade 480 engages groove 447 on first blade 440. Fastener 460 is inserted through apertures 433 and 489 to couple third blade 480 to body 420. Third blade 480 further secures first blade 440 and second blade 450 in place. According to an exemplary embodiment, fastener 460 is a set screw. Alternatively, fastener 460 may be a pin, rivet, dowel, or other suitable fastener. Fastener 460 may extend in a direction that intersects with longitudinal axis 422 and may extend into a portion of body 420 to engage a threaded aperture in body 420. Alternatively, fastener 460 may be provided offset relative to axis 422 and more than one fastener may be used according to various alternative embodiments.

Figure 8:
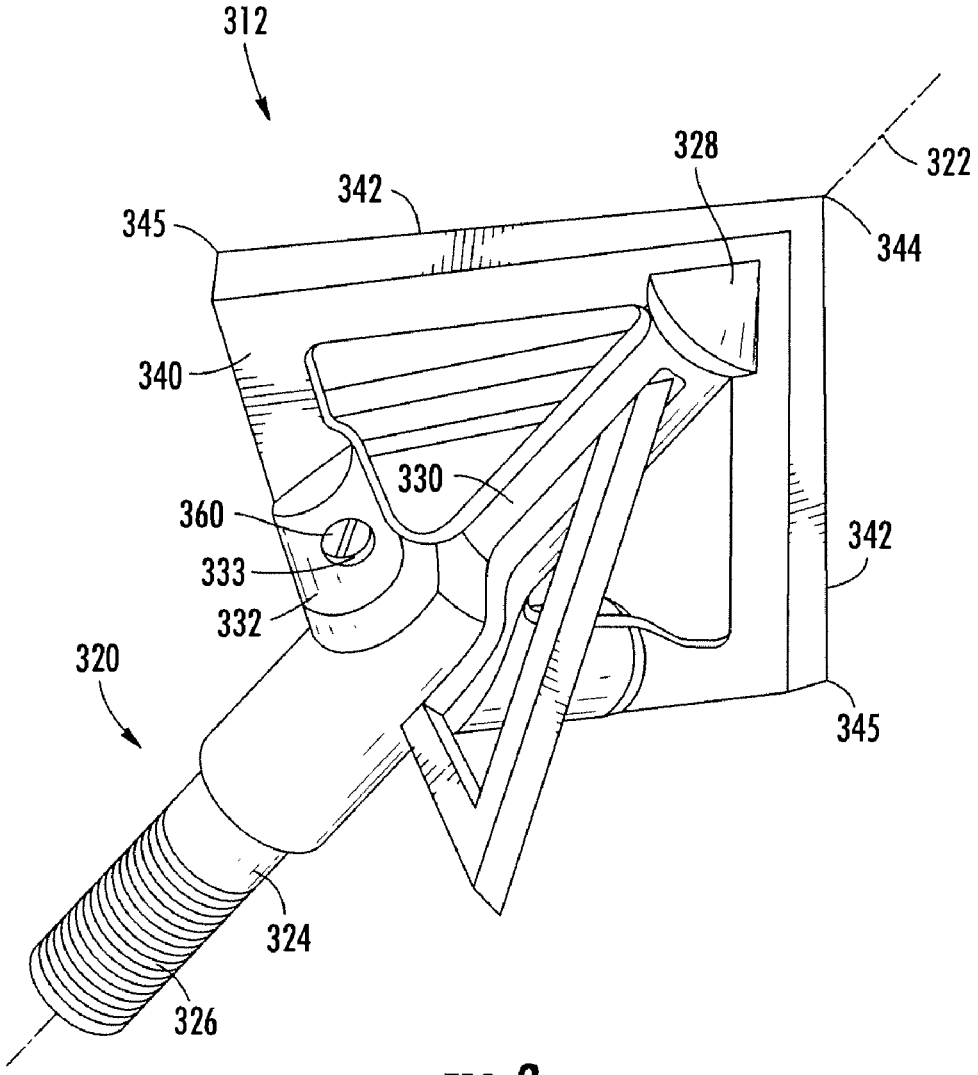
FIG. 8 is a perspective view of an arrowhead according to another exemplary embodiment.
Figure 9:
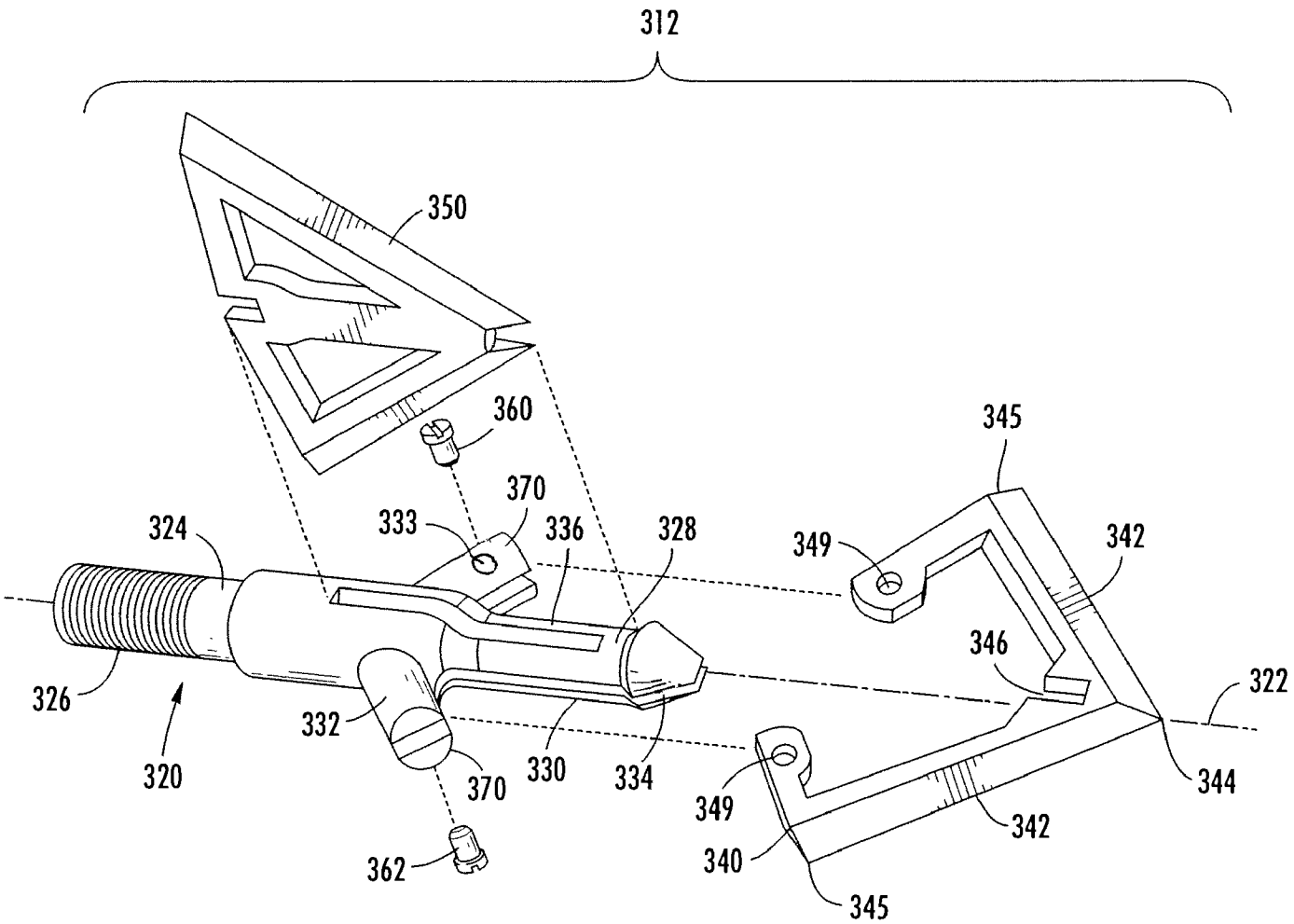
FIG. 9 is an exploded perspective view of the arrowhead of FIG. 8 according to an exemplary embodiment.

Referring now to FIGS. 8 and 9, an arrowhead 312 is shown according to an exemplary embodiment. Arrowhead 312 may be similar to arrowhead 12 of FIG. 4 and may include a main body or ferrule 320, a first blade 340, a second blade 350 secured between first blade 340 and body 320, and fasteners 360 and 362 that secure one or more of blades 340, 350 to body 320. Blades 340, 350 may be configured to be removable (e.g., replaceable) and blade 340 is arranged such that it extends beyond body 320 to form a cut-on-contact tip for arrowhead 312.

Body 320 is similar to body 20 of arrowhead 12. Body 320 is an elongated member that has a longitudinal axis 322 that is coaxial with shaft 14 (see, e.g., FIG. 2). Body 320 includes a rear portion 324 and a forward portion 328 with recesses 334, 336 that receive first blade 340 and second blade 350, respectively. Rear portion 324 includes threads 326 and is configured to engage threaded socket 18 to couple arrowhead 312 to shaft 14. Forward portion 328 includes a first or elongated portion 330 and a second or enlarged portion 332 proximate to rear portion 324. According to one exemplary embodiment, second portion 332 forms a pair of opposing extensions or arms 370. Arms 370 include apertures 333 that are offset from longitudinal axis 322 and are aligned with corresponding apertures 349 in first blade 340. For example, according to one embodiment, apertures 333 may extend in a direction that does not intersect axis 322. According to another embodiment, apertures 333 may extend orthogonally relative to axis 322 and be spaced from axis 322 at equal of unequal distances. According to yet another embodiment, one or more of apertures 333 may extend in a plane that is parallel and spaced apart from a plane that encompasses axis 322. Apertures 333 receive fasteners 360 and 362 to couple first blade 340 to body 320.

First blade 340 may be a replaceable blade and may be removable from body 320. First blade 340 includes a pair of cutting edges 342. Each of cutting edges 342 extends from a tip 344 to an apex 345 to form a side of blade 340. According to an exemplary embodiment, arms 370 may extend toward apexes 345 such that apertures 333 may be provided at any location along arms 370. Furthermore, in some embodiments, arms 370 may extend to apex 345 and include a bend, or curve, such that arms 370 may also extend in the direction of cutting edges 342. Providing apertures 333 proximate apexes 345 may provide greater stability for blade 340 relative to configurations where blade 340 is secured at a location on or proximate axis 322, by providing a wider attachment feature. First blade 340 includes a pair of apertures 349 on either side of axis 322. When arrowhead 312 is assembled, apertures 349 are aligned with apertures 333 in body 320. According to an exemplary embodiment, second blade 350 may be substantially similar to blade 250, and have one or more apertures configured to permit airflow through blade 350 during flight.

As discussed above with respect to arrowhead 12, arrowhead 312 is similarly assembled by inserting second blade 350 into recess 336 of body 320 from the side and then sliding first blade 340 into recess 334 of body 320 perpendicular to second blade 350 to secure second blade 350 in place. When blade 340 is fully seated in body 320, apertures 349 are aligned with apertures 333 in body 320. First fastener 360 and second fastener 362 are provided on either side of longitudinal axis 322 (e.g., offset) and are inserted through apertures 349 to couple first blade 340 to body 320.

Figure 14A:
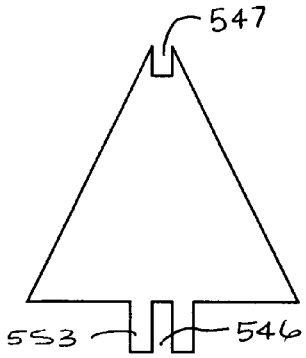
FIGS. 14A-14M illustrate various portions of an arrowhead according to various exemplary embodiments.
Figure 14B:
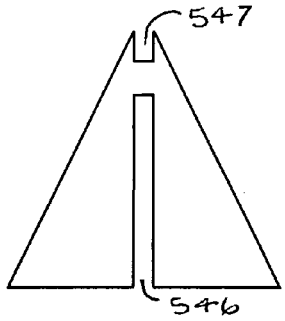
Figure 14C:
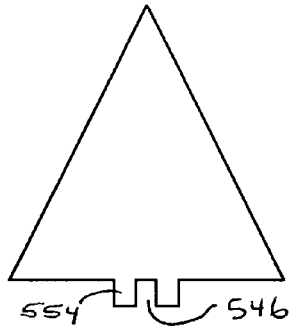
Figure 14D:
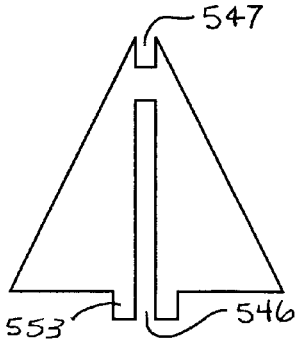
Figure 14E:
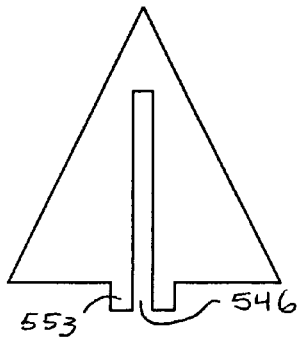

Referring now to FIGS. 14A-14M, various portions of arrowheads are shown according to various exemplary embodiments. As shown in FIGS. 14A-14E, a blade for an arrowhead may include an extended first slot 546 (FIGS. 14B, 14D, and 14E) as similarly illustrated with respect to first blade 40 in FIG. 4, or a relatively shorter first slot 546 (FIGS. 14A and 14C) as similarly illustrated with respect to second blade 150 in FIG. 5. A second groove or slot 547 to receive a second blade may be provided on the blade (FIGS. 14A, 14B, 14D) or may be omitted (FIGS. 14C and 14E). Any of the blades of FIGS. 14A-14E may include apertures to allow airflow through the blade. Also, in some embodiments, any of the blades may include one or more apertures that receive fasteners to secure the blade, as illustrated with respect to aperture 49 of blade 40 shown in FIG. 4. Furthermore one or more blades may have a generally flat rear portion (FIG. 14B), or be provided with a pair of extensions 553 or 554 (FIGS. 14A, 14C-14E) that may be of varying lengths to suit a particular application.

Figure 14F:
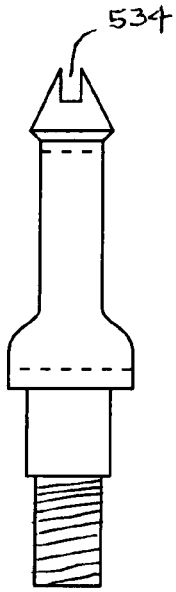
Figure 14G:
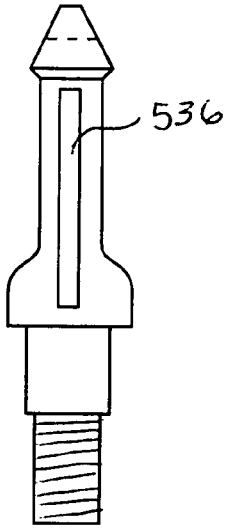
Figure 14H:
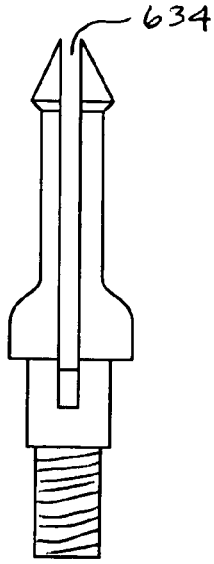
Figure 14I:
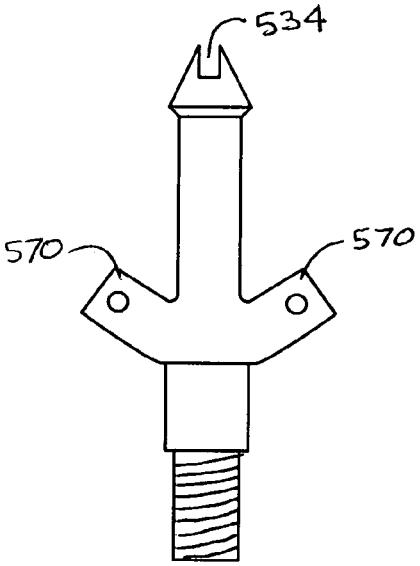
Figure 14J:
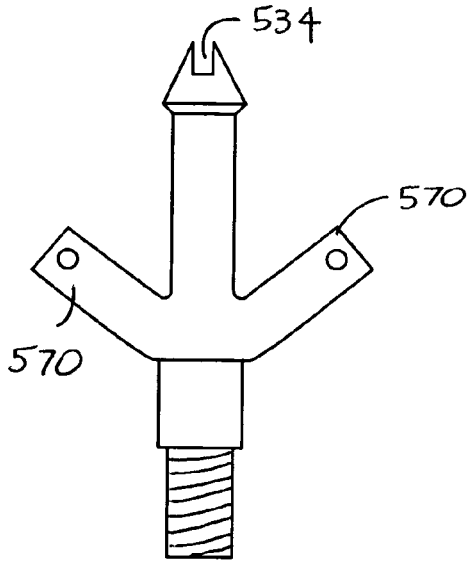

As shown in FIGS. 14F-14H, the body may be coupled to blades with various mechanisms. As shown in FIGS. 14F-14G, the body may have a first recess or groove 534 that extends only a short distance (e.g., less than one-quarter of the body length) into the tip of the body and a second groove or recess 536 that is similar to recess 236 of FIG. 7A. As shown in FIG. 14H, the body may have a first recess or groove 634 that extends through the body (e.g., at least one-half, two-thirds, or three quarters of the length of the body) and extends along the body to receive a blade such as that shown in FIG. 14C. As shown in FIG. 14I, the body may include a pair of extending arms 570 similar to arms 370 of FIG. 9. As show in FIG. 14I, arms 570 extend at an angle (e.g., 30 degrees) from the body, but may be provided at varying angles according to various exemplary embodiments. As shown in FIG. 14J, arms 570 may extend further from the body such that arms 570 extend substantially to a cutting edge of a blade, and may include one or more apertures to secure a blade.

Figure 14K:
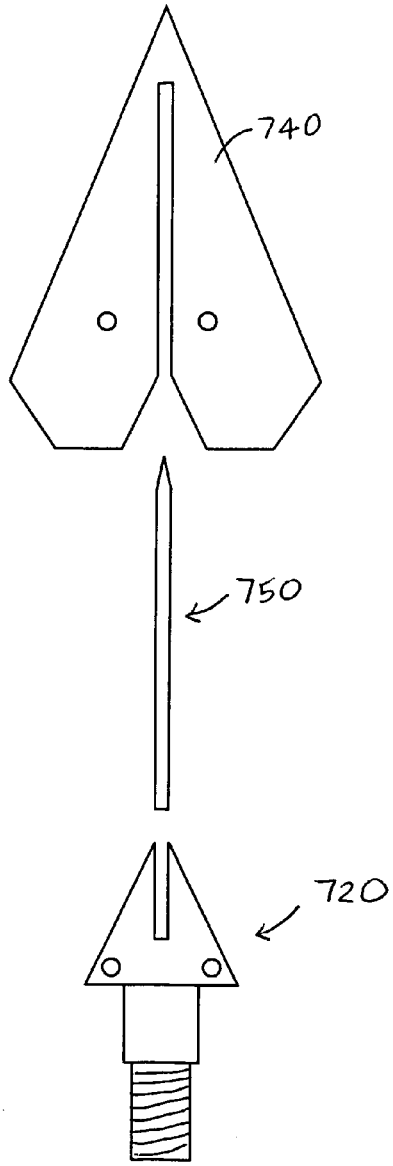
Figure 14L:
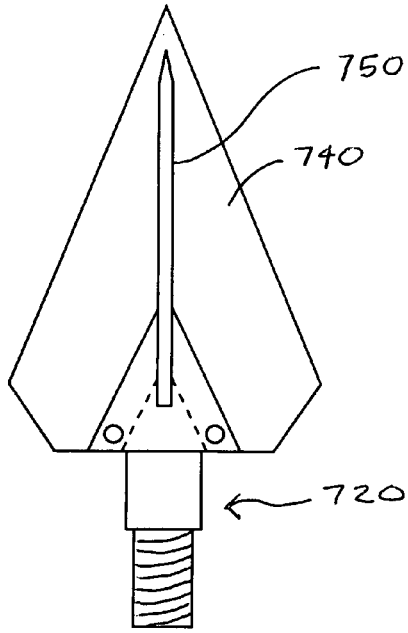

Referring to FIGS. 14K and 14L, a body 720 may be provided that is substantially shorter than the bodies shown in the other embodiments. In some embodiments, body 720 extends along less than one-half, or less than one-third, or less than one-quarter, the length of blades 740, 750. Blades 740, 750 may be secured as discussed with respect to any of the embodiments disclosed herein.

Figure 14M:
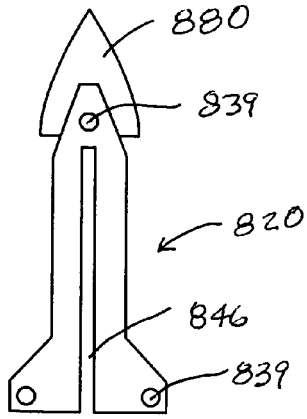

Referring to FIG. 14M, a second body or ferrule 820 may be provided. According to an exemplary embodiment, second body 820 is coupled to another body (e.g., body 720 shown in FIG. 14K), and is provided with one or more apertures 839 and one or more slots 846 to secure blades (e.g., blade 880.

It should be noted that the various exemplary embodiments and the features thereof may be utilized in combination with each other to suit particular applications. For example, arms 370 shown in FIG. 8 may be used in conjunction with the blades shown in FIG. 2. Furthermore, the various features shown in FIGS. 14A-14M may be used alone or in combination with the various other exemplary embodiments disclosed herein. All such combinations of features are within the scope of the present disclosure.

It is important to note that the arrangement of the arrowhead, as shown, are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited herein. Accordingly, all such modifications are intended to be included within the scope of the present disclosure as described herein. The order or sequence of any process or method steps may be varied or re-sequenced according to alternative embodiments. Other substitutions, modifications, changes, and/or omissions may be made in the design, operating conditions and arrangement of the preferred and other exemplary embodiments without departing from the scope of the present disclosure as expressed herein.

What is claimed is:

1. An arrowhead, comprising:

a body having a longitudinal axis, a portion of the body having a generally circular cross section;

a first fixed blade;

a second blade;

a first fastener that extends through a portion of the body and engages the first fixed blade to secure the first fixed blade in a fixed position relative to the body;

wherein the first fastener is offset relative to the longitudinal axis and is disposed within the portion of the body having the generally circular cross section; and wherein the first fixed blade is a generally planar blade and extends beyond a forward end of the body to provide a cut-on-contact cutting tip;

wherein the body comprises a recess and the first blade is provided at least partially within the recess, wherein the recess comprises a first groove and a second groove, wherein the first blade is received in the first groove and the second blade is received in the second groove; and wherein the first fastener comprises a pair of fasteners that engage only the first blade and do not engage the second blade.

2. The arrowhead of claim 1, wherein the second blade is secured between the first blade and a portion of the body.

3. The arrowhead of claim 1, further comprising:

a ring member configured to be located between a portion of the body and an arrow shaft;

wherein the second blade is secured between the first blade and the ring member;

wherein the ring member extends about a portion of the second blade.

4. The arrowhead of claim 1, wherein the first blade and the second blade are generally planar blades and extend beyond the forward end of the body.

5. The arrowhead of claim 1, wherein the first blade is a replaceable blade and is removable from the body.

6. The arrowhead of claim 1, wherein the first blade has a first pair of cutting edges each having a first length, and the second blade has a second pair of cutting edges each having a second length approximately the same as the first length.

7. The arrowhead of claim 6, wherein the first blade comprises at least one first aperture and the second blade comprises at least one second aperture approximately the same size as the first aperture, the first and second apertures configured to permit air to flow through the apertures.

8. The arrowhead of claim 1, further comprising a second fastener, wherein the first fastener extends into the body on a first side of the longitudinal axis, and the second fastener extends into the body on a second side of the longitudinal axis.

9. The arrowhead of claim 8, wherein the body comprises an elongate first portion that extends along the longitudinal axis and a second portion that extends from the first portion.

10. The arrowhead of claim 9, wherein the first and second fasteners each extend into the second portion.

11. The arrowhead of claim 1, wherein the second blade comprises a first slot extending along a portion of the second blade that engages the second groove in the body and a second slot that extends along a second portion of the second blade and engages the first blade.

12. The arrowhead of claim 11, wherein the first blade includes a third slot that engages the second slot in the second blade and the first groove in the body.

13. The arrowhead of claim 12, wherein the first slot extends along a substantial portion of the length of the second blade and the third slot extends along a substantial portion of the length of the first blade.

14. The arrowhead of claim 12, wherein the second groove in the body extends along a substantial portion of the length of the body.

15. The arrowhead of claim 1, wherein the fastener is one of a screw, a rivet, and a pin.

16. An arrowhead, comprising:

a body having a longitudinal axis and a recess extending along a portion of the longitudinal axis, a portion of the body having a circular cross section;

a first fixed blade provided at least partially within the recess, the first fixed blade being a generally planar blade;

a second blade;

a pair of fasteners;

wherein the fasteners are disposed within the portion of the body having the circular cross section and extend into the body offset relative to the longitudinal axis to secure the first fixed blade in a fixed position relative to the body;

wherein the fasteners engage only the first fixed blade and do not engage the second blade wherein the first and second blades are arranged substantially orthogonally with respect to each other.

17. The arrowhead of claim 16, wherein the first blade extends beyond the second blade relative to the forward portion.

18. The arrowhead of claim 16, wherein the first and second blades are removably coupled to the body.

19. An arrowhead comprising:

a body comprising an elongate first portion having a longitudinal axis and a circular cross section along at least a portion of the longitudinal axis of the first portion;

a first blade configured to be held in a first fixed position relative to the body;

a second blade configured to be held in a second fixed position relative to the body; and first and second fasteners;

wherein the first and second fasteners extend into the body on opposite sides of the longitudinal axis to removably couple the first blade to the body in the first fixed position;

wherein the second blade is positioned between the first blade and a portion of the body in the second fixed position; and wherein the first and second fasteners engage only the first blade and do not engage the second blade.

20. The arrowhead of claim 19, wherein the first portion defines a length of the body and has a rear portion and a forward portion; and wherein the first and second blade both are generally planar blades and extend beyond the forward portion to define a cut-on-contact cutting portion.

21. The arrowhead of claim 20, wherein at least one of the first blade and the second blade comprises a pair of cutting edges, wherein each cutting edge extends from a tip that extends beyond the forward portion to an apex, wherein a second portion of the body extends from the first portion toward the apex.

22. The arrowhead of claim 21, wherein the second portion extends substantially to the apex.

* * * * *